US010583057B2

(12) United States Patent
Bux

(10) Patent No.: US 10,583,057 B2
(45) Date of Patent: Mar. 10, 2020

(54) SYSTEM FOR TURNING A PATIENT OVER IN A BED

(71) Applicant: NEW YORK SOCIETY FOR THE RUPTURED AND CRIPPLED MAINTAINING THE HOSPITAL FOR SPECIAL SURGERY, New York, NY (US)

(72) Inventor: Tazeem Bux, Queens, NY (US)

(73) Assignee: NEW YORK SOCIETY FOR THE RUPTURED AND CRIPPLED MAINTAINING THE HOSPITAL FOR SPECIAL SURGERY, New York, NY (US)

( * ) Notice: Subject to any disclaimer, the term of this patent is extended or adjusted under 35 U.S.C. 154(b) by 142 days.

(21) Appl. No.: 15/667,274

(22) Filed: Aug. 2, 2017

(65) Prior Publication Data

US 2018/0036187 A1 Feb. 8, 2018

Related U.S. Application Data

(60) Provisional application No. 62/370,808, filed on Aug. 4, 2016.

(51) Int. Cl.
*A61G 7/00* (2006.01)
*A61G 7/10* (2006.01)
*A61G 7/05* (2006.01)

(52) U.S. Cl.
CPC ..... *A61G 7/001* (2013.01); *A61G 7/0507* (2013.01); *A61G 7/1051* (2013.01)

(58) Field of Classification Search
CPC ..... A61G 7/001; A61G 7/1051
See application file for complete search history.

(56) References Cited

U.S. PATENT DOCUMENTS 1,078,090 A * 11/1913 Foss ..... A61G 7/1046 5/129
1,197,472 A * 9/1916 Foy ..... 5/89.1
3,099,842 A * 8/1963 Lee ..... A61G 7/1009 5/84.1
3,458,878 A * 8/1969 Combs ..... A61G 7/1023 128/876
3,506,985 A 4/1970 Lang
(Continued)

OTHER PUBLICATIONS

Rost, Harriette. "TomiTurn Helps Turn Bed Bound Patients." YouTube, YouTube, Sep. 14, 2011, www.youtube.com/watch?v=WY-bh7brwJ8.

(Continued)

*Primary Examiner* — Eric J Kurilla
(74) *Attorney, Agent, or Firm* — Leason Ellis LLP

(57) ABSTRACT

A system for controllably turning over a patient in a bed includes a flexible body sling and a ratchet device. The flexible body sling includes a main torso portion that terminates in a first end and an opposing second end and is configured for placement under the patient between a head and a tailbone of the patient. The flexible sling has a first sling strap that is coupled to the first end and a second sling strap that is coupled to the second end. The ratchet device has a mount that includes a curved portion for placement over a side rail of the bed to detachably secure the ratchet device to the bed. The ratchet device has a rotatable spool with a slot for receiving one of the first sling strap and the second sling strap. The ratchet device has a pivotable handle for driving the rotatable spool.

20 Claims, 10 Drawing Sheets

(56) References Cited

U.S. PATENT DOCUMENTS

| | | | | |
|---|---|---|---|---|
| 4,507,814 | A * | 4/1985 | Zyki, Jr. | A61G 7/1009 5/81.1 T |
| 4,944,057 | A | 7/1990 | Shaw | |
| 5,274,862 | A | 1/1994 | Palmer | |
| 5,359,739 | A | 11/1994 | Rains et al. | |
| 6,321,398 | B1 | 11/2001 | Wang | |
| 6,393,636 | B1 | 5/2002 | Wheeler | |
| 6,671,899 | B1 | 1/2004 | Oja | |
| 6,772,456 | B2 | 8/2004 | Votel | |
| 8,915,549 | B2 * | 12/2014 | Addiego | A61G 5/14 297/463.2 |
| 2005/0055769 | A1 | 3/2005 | Taylor | |
| 2005/0103350 | A1 | 5/2005 | Henry | |
| 2015/0342808 | A1 | 12/2015 | Lasczyk | |
| 2018/0036187 | A1 | 2/2018 | Bux | |

OTHER PUBLICATIONS

1800wheelchair. "4104 RoMedic TopSheet Patient Turning Device." *YouTube*, YouTube, Jul. 19, 2012, www.youtube.com/watch?v=F1BrCJfQKvw.

Medical, CJ. "HoverTech HT-Roller." *YouTube*, YouTube, Sep. 9, 2015, www.youtube.com/watch?v=kBt96EzbQVk.

"ToTo™—Lateral Turning System." *Repose*, Frontiermedical Group, www.reposedirect.com/product/toto/. Oct. 21, 2016.

SageProducts LLC. "Prevalon™ AirTAP System™ Training Video." *YouTube*, YouTube, Aug. 9, 2016, www.youtube.com/watch?v=E8iFbB7ERxY.

ProBedMedical. "Patient Rotation Bed System—The Freedom Bed by ProBed Medical." *YouTube*, YouTube, Jun. 14, 2014, www.youtube.com/watch?v=NfVBwc-K4rU.

Vguldmann. "Guldmann Sling Instruction: Turner Sling—Turning Patient in Bed." *YouTube*, YouTube, Jan. 10, 2013, www.youtube.com/watch?v=wtt0g-Mz0mA.

"SafetySure Transfer Gurney without Plastic Insert—Large: Health & Personal Care." *Amazon.com: SafetySure Transfer Gurney without Plastic Insert—Large: Health & Personal Care*, 2015, www.amazon.com/SafetySure-Transfer-Gurney-without-Plastic/dp/B00I5PV0ZG/ref=sr_1_4 a_it?ie=UTF8&qid=1501705419&sr=8-4&keywords=SafetySure%2BTransfer%2BGurney.

"Grooming Body Sting (adjustable)." Blackdog, Black Dog Wear Pty Ltd, Feb. 18, 2017 (Feb. 18, 2017), p. 1. www.blackdog.net.au/dog-body-sling.

* cited by examiner

SYSTEM FOR TURNING A PATIENT OVER IN A BED

CROSS-REFERENCE TO RELATED APPLICATION

The present application claims priority to and the benefit of U.S. patent application Ser. No. 62/370,808, filed Aug. 4, 2016, which is hereby incorporated by reference in its entirety.

TECHNICAL FIELD

The present invention relates generally to a system that is intended for use bedside in order to move a patient lying in a bed and more particularly, relates to a ratchet based system that is configured to allow a single health-care worker to easily and gently turn a patient over in their bed.

BACKGROUND

Traditionally, turning a patient and changing his or her sheets is a two-person job, as the patient must not only be turned onto his or her side, but also held there while the patient is cleaned (e.g., bathed, etc.) and their sheets are changed. By requiring two people to perform this task, valuable resources are potentially wasted and there is therefore a need for an improved system that permits a single health-care to easily and efficiently perform this entire task, with no discomfort to the patient.

SUMMARY

A system for controllably turning over a patient in a bed includes a flexible body sling and a ratchet device. The flexible body sling includes a main torso portion that terminates in a first end and an opposing second end and is configured for placement under the patient between a head and a tailbone of the patient. The flexible sling has a first sling strap that is coupled to the first end and a second sling strap that is coupled to the second end. The ratchet device has a mount that includes a curved portion for placement over a side rail of the bed to detachably secure the ratchet device to the bed. The ratchet device has a rotatable spool with a slot for receiving one of the first sling strap and the second sling strap. The ratchet device has a pivotable handle for driving the rotatable spool.

BRIEF DESCRIPTION OF THE DRAWING FIGURES

DETAILED DESCRIPTION OF CERTAIN EMBODIMENTS

In accordance with the present invention, a system or device 100 is provided and is configured to be used with hospital beds and the like, where immobile patients must be regularly turned in order to maintain skin hygiene and to change their sheets. As described herein and according to one exemplary embodiment, the system 100 is a strap-and-ratchet based system that is configured to allow a single health-care worker to easily and gently turn a patient over in their bed, thereby benefiting both the health-care worker and the patient.

Figure 1:
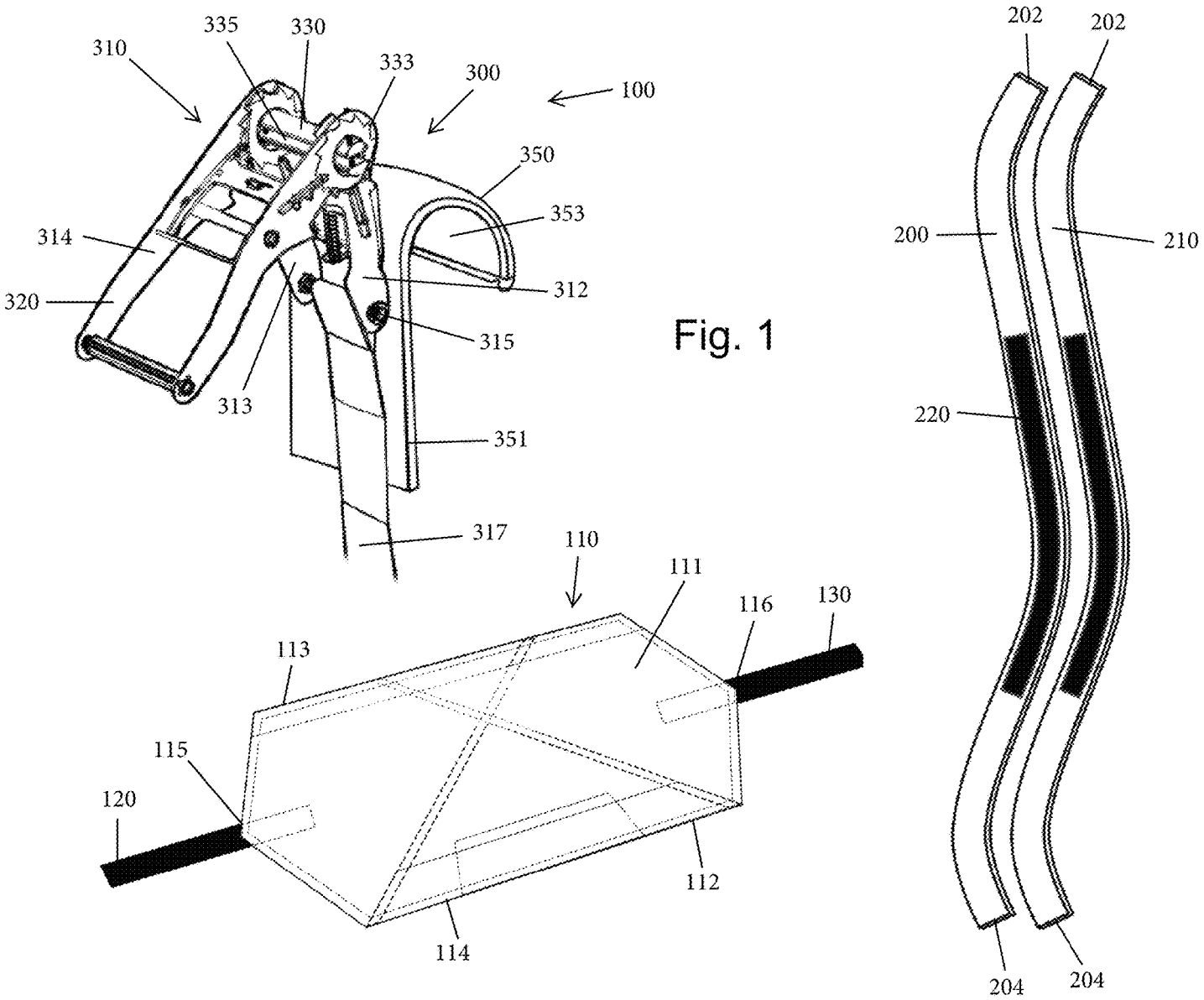
FIG. 1 is a view of a system for controllably and at least partially turning over a bedridden person to allow for patient care and for changing of bed sheets.

The system 100 includes a number of components (parts) that interact with one another to provide an operative system that can easily secured to a bed and then subsequently used to controllably turn over the patient in the bed. As shown in FIG. 1, the system 100 includes a sling 110 that is configured to fit underneath the patient and extend outwardly on both sides of the patient; a first strap 200, a second strap 210, and a ratchet device/mechanism 300.

The sling 110 has a first side or face 111 and an opposite second side or face 112. The sling 110 is also defined by a first edge 113 and an opposing second edge 114 and has a first end 115 and an opposing second end 116. The sling 110 is configured and constructed in view of the anatomy of the patient in that it is constructed to fit underneath the patient and then, when manipulated, is configured to at least partially turn the patient over within the bed.

As shown in FIG. 1, the first edge 113 and the second edge 114 can be parallel edges and each of the ends 115, 116 can be in the form of an angled end defined by two end edges that converge and intersect one another at a point. The lengths of the first edge 113 and second edge 114 can be the same. Opposite ends of the end edges connect to the first edge 113 and the second edge 114. The sling 110 is sized so that when a person is placed on top of the sling 110, the ends 115, 116 extend beyond the person's body and are accessible.

At the first end 115, the sling 110 includes a first sling strap 120 that extends radially outward from the first end 115 and a second sling strap 130 that extend radially outward from the second end 116. In the illustrated embodiment, the first sling strap 120 is joined to the first end 115 at a location where the end edges come to a point (using traditional techniques, such as stitching and the like). Similarly, the second sling strap 130 is joined to the second end 116 at a location where the end edges come to a point (using traditional techniques, such as stitching and the like).

It will also be understood that the sling 110 can come in any number of different sizes and thus, there can be a variety of adult sizes (e.g., S, M, L, XL) and also child sizes.

The sling 110 can be formed of any number of suitable materials, including but not limited to various types of fabrics, including but not limited to natural fabrics, synthetic fabrics, etc. The first and second sling straps 120, 130 can be formed of any number of different materials, including but not limited to natural or synthetic fabrics, such as nylon.

The first and second straps 200, 210 are in the form of elongated straps that have free first ends 202 and second ends 204. Along their length, each of the first and second straps 200, 210 includes a first fastener 220 on one side (face) thereof and an opposite side (face) includes a second fastener that is complementary to the first fastener 220 to allow one end of the strap 200, 210 to be folded over itself and attached to an intermediate location of the strap 200, 210. This allows the strap 200, 210 to form a loop and be attached about a support structure, such as a bed rail as described herein. As shown, the first fastener 200 can be formed along an intermediate section of the first face of each strap 200, 210 and the second fastener can be formed at one or both of the ends along the second face of each strap 200, 210. Thus, when either end is folded over, the second fastener is brought into mating engagement with the first fastener 200 to attach the one end to an intermediate portion of the strap 200, 210.

It will be understood that any number of different types of fasteners can be used for the first fastener 220 and the one or more second fastener. For example, the fastener can be in the form of a snap, hook and loop material, button, etc. In the illustrated embodiment, the first fastener 220 is shown as being a strip of hook and loop material. In the illustrated embodiment, the first fastener 220 is centrally located within the strap.

The first and second strap 200, 210 can be formed of any number of different materials, including but not limited, to natural fabrics (e.g., cotton) or synthetic fabrics, such as nylon.

The lengths of the first and second straps 200, 210 can be selected based on a number of different parameters, including but not limited to the size of the patient and size and construction of the bed, etc. In one exemplary embodiment, the length of each of the first and second straps 200, 210 is about 4 feet. However, as mentioned, other dimensions are equally possible.

It will also be understood that each of the first and second straps 200, 210 can be free of fasteners and instead, the user can simply tie that strap 200, 210 in a knot to secure the strap onto a support structure, such as a bed rail as described below.

As mentioned previously, the ratchet mechanism 300 is also a part of the system 100. The ratchet mechanism 300 is configured to receive and operate on one of the first sling strap 200 and the second sling strap 210 so as to controllably tighten the strap 200, 210.

As is known, a ratchet is a mechanical device that allows continuous linear or rotary motion in only one direction while preventing motion in the opposite direction. Ratchets are widely used in machinery and tools. One type of ratchet is a ratchet that is intended to receive and wind a strap is known as a ratchet tie-down strap mechanism.

FIG. 1 shows ratchet device 300 that is configured for use with the system 100 of the present invention. The ratchet device 300 includes a ratchet portion 310 and a mount portion 350. The ratchet portion 310 includes a base portion or first leg 312 and a handle or leg 314 that is pivotally coupled to the first leg 312. The base portion 312 is intended to be a fixed portion and can include a pair of spaced apart fingers 313 that are connected to each other at the bottoms thereof by a pin 315. About the pin 315, a securing strap 317 can be secured. The securing strap 317 can have a fastener at a free end thereof to facilitate mounting and the securing the base portion 312 to a support structure. For example, the free end of the securing strap 317 can include a hook or claw to attach the ratchet device 300 to the support structure. However, in view of the mount portion 350 that is incorporated into the ratchet device 300, the securing strap 317 can be eliminated. The fingers 313 also include slots 319 in which a spring loaded tab or pawl is located.

The handle 314 can be defined by a pair of spaced fingers 320 with one or more cross-bars 322 extending therebetween. One of the cross-bars 322 is at the free distal ends of the fingers 320 and defines a handle portion that a user can grasp to pivot the handle 314 relative to the base portion 312. The area between fingers 320 is of a size that can receive the hand (fingers) of the user.

The ratchet device 300 includes a rotatable spool 330 that is operatively coupled to the handle 314 such that pivoting action of the handle 314 causes rotation of the rotatable spool 330. The rotatable spool 330 has ratchet teeth 333 that engage the spring loaded pawl to restrict rotation of the rotatable spool 330 in only one direction. This defines the ratchet action of the ratchet device 300. When the user pivots the handle 314, the rotatable spool 330 is caused to rotate the one spool 330 in the one direction for a stated increment with the pawl preventing backspin of the rotatable spool 330.

The rotatable spool 330 has a slot 335 that is formed therethrough along the length of the spool 330 such that the slot 335 extends between the fingers 320. The slot 335 is sized to receive webbing which in this case is one of the first sling strap 120 or the second sling strap 130. In one exemplary embodiment, the slot 335 is configured to receive a two inch width webbing (first sling strap 120 or second sling strap 130).

It will be appreciated that the ratchet device 300 can be motorized in that the rotation of the spool 330 can be under action of a motor. A controller or actuator (such as a button) is provided to control operation of the motorized ratchet device 300. The controls can also include a lever or buttons to allow the direction of rotation of the spool 330 to be controlled (for winding or unwinding the sling strap). The motor can be powered by a battery that can be stored as part of the housing. The entire unit can still include the J-hook mount that allows the entire battery powered unit to hang along the bed rail.

In addition, the sling can include indicia (visual markings) to identify the location at which the torso of the patient should be placed.

Ratchet Tie Down Tensioning

Generally, the following steps are followed to use the ratchet mechanism 300:

1. place the webbing through slot in the center rotating spool of ratchet mechanism in order to thread the ratchet buckle;
2. pull webbing through the slot, leaving some slack;
3. start ratcheting (raising and lowering handle);
4. webbing will wind itself and be locked in place so that further ratcheting will rapidly increase tension in strap.

Ratchet Tie Down Buckle Release Instructions

1. To release, pull and hold a release tab on top assembly to override ratcheting function;
2. open ratchet until it is completely open and flat;
3. grab webbing from non-fixed side and pull to release webbing; and
4. pull and hold release tab on top assembly to close ratchet.

In contrast to conventional tie down ratchet strap devices, the ratchet device 300 includes the mount portion 350. The base portion 312 can be fixedly attached to the mount portion 350. The mount portion 350 is specifically constructed to mount to a hospital bed such as the one shown in the figures and more particularly, the mount portion 350 is configured to releasably attach to a rail of the bed. In the illustrated embodiment, the mount portion 350 is J-shaped and thus, represents a J-hook having a straight portion 351 and a curved hook portion 353. The base portion 312 can be fixedly attached to the straight portion 351 along a rear surface thereof opposite the curved hook portion 353. The curvature of the curved hook portion 353 is selected in view of the construction of the rail of the hospital bed since reception of the bed rail within the curved hook portion 353 comprises the means by which the ratchet device 300 is secured to the bed rail.

The handle 314 remains freely accessible and operational in this mounted position.

The mount portion 350 can be formed of any number of different materials, such as metals, plastics, wood, etc.

As described in more detail below, the ratchet device 300 provides an easy and effective way for the health-care worker to manipulate the sling 110 so as to turn the patient over.

Figure 2:
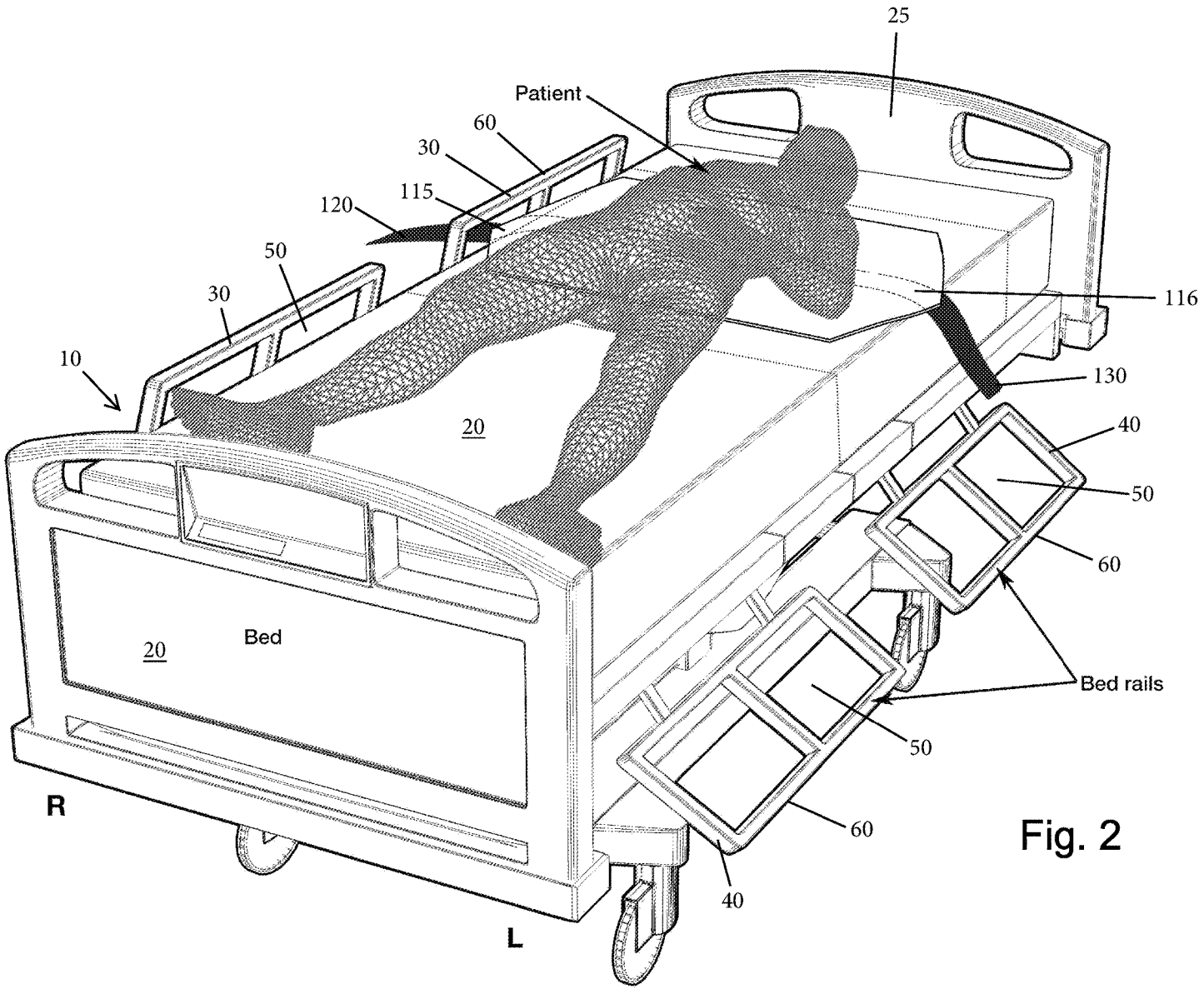
FIG. 2 is a perspective view of the system illustrating a first step of a method for securing the system to a bed and controllably turning over the person.

FIGS. 2-10 disclose steps for at least partially turn over a patient using the system 100. FIG. 2 shows a conventional hospital bed 10 that includes a mattress 20 and a bed frame including a first side rail 30 and an opposing second side rail 40. The side rails 30, 40 are located between a headboard 25 and a footboard 26 of the bed 10. In addition, as shown, each of the first side rail 30 and the second side rail 40 can be formed of several separate rail structures. One or both of the side rails 30, 40 can open and close in that the side rails 30, 40 are pivotally coupled to the bed frame. As shown, each of the first side rail 30 and the second side rail 40 includes one or more slotted openings 50 defined in part by a top rail 60.

As shown in FIG. 2, the system 100 is installed by placing the sling 110 underneath the patient with the main center portion of the sling 100 being disposed directly underneath the patient's body, with the ends 115, 116 being disposed to the respective sides of the patient's body. In this position, the first sling strap 120 and the second sling strap 130 are fully accessible. The sling 110 is thus placed under the draw sheet of the bed 10 and is placed between the head and tailbone of the patient. In FIG. 2, the side rail(s) 40 are shown in the down position to allow installation and placement of the sling 110 underneath the patient.

Figure 3:
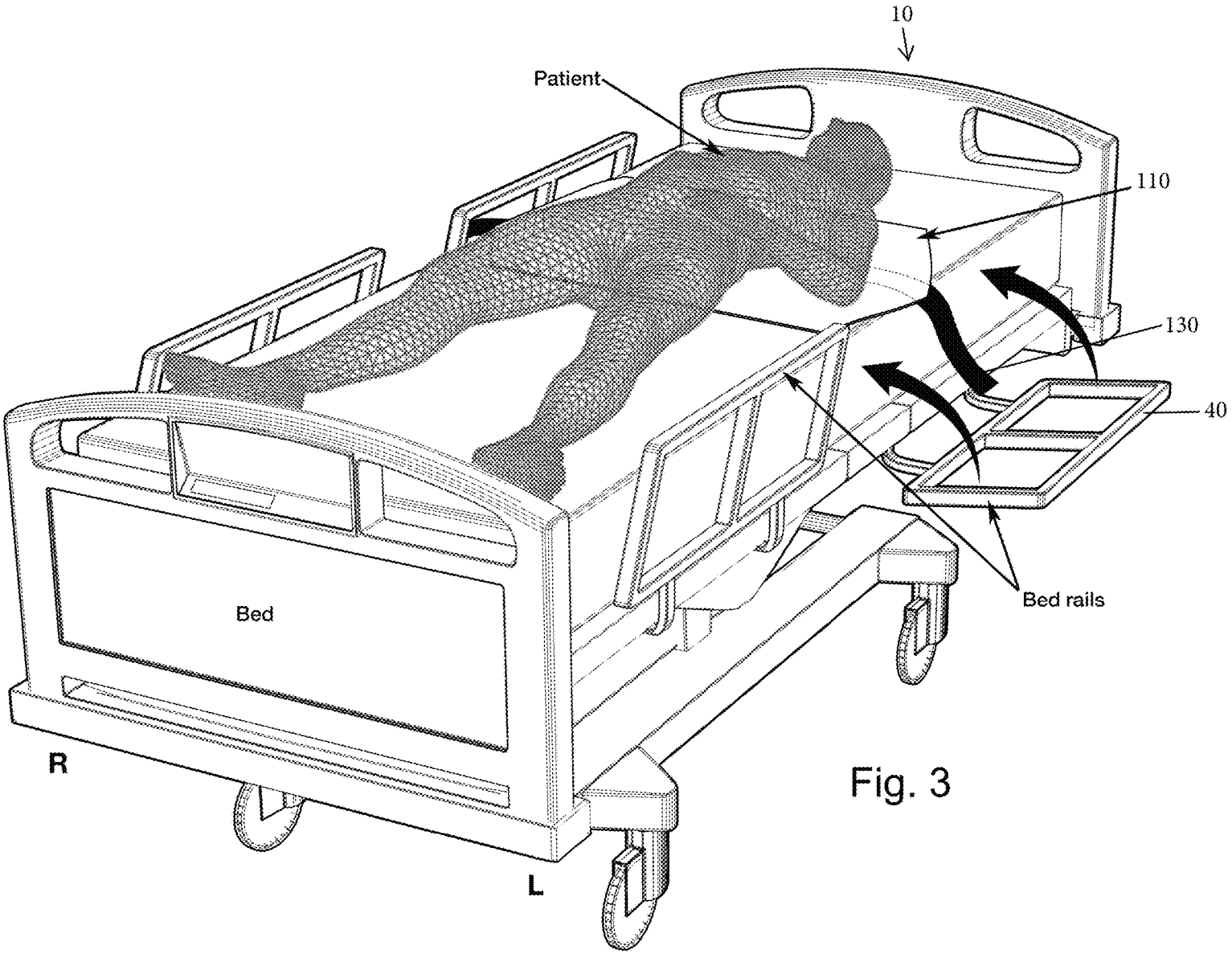
FIG. 3 is a perspective view of the system illustrating a second step of the method.

FIG. 3 shows the side rail(s) 40 being moved to the up position. The first sling strap 120 and second sling strap 130 are shown as lying loose on bed 10.

Figure 4:
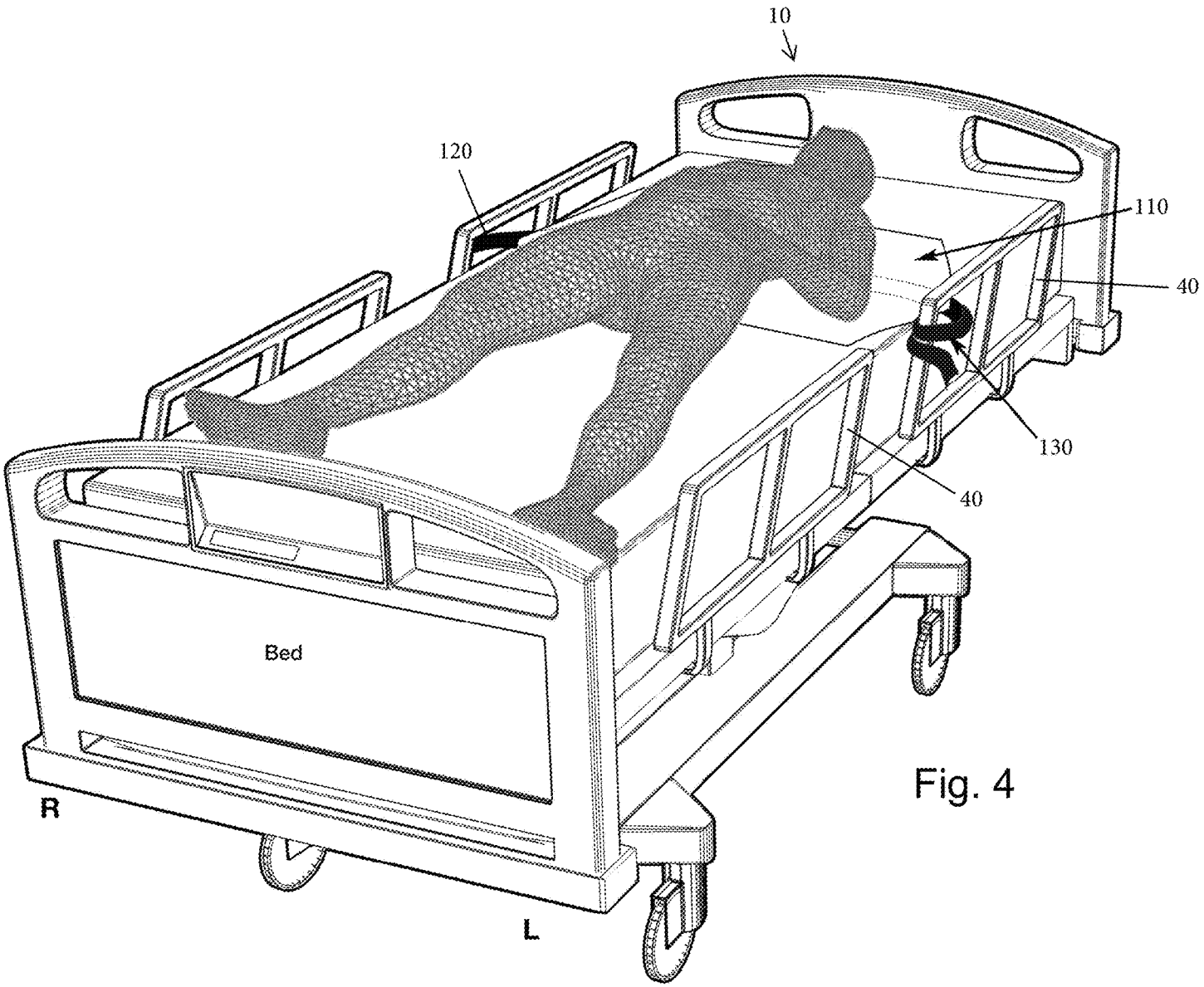
FIG. 4 is a perspective view of the system illustrating a third step of the method.

FIG. 4 shows the second sling strap 130 being secured to the side rail 40 as by tying the second sling strap 130 to the side rail 40. While tying a knot is one way of attaching the second sling strap 130, it will be appreciated that other techniques can be used to secure the second sling strap 130 including but not limited to use of fasteners and the like.

Figure 5:
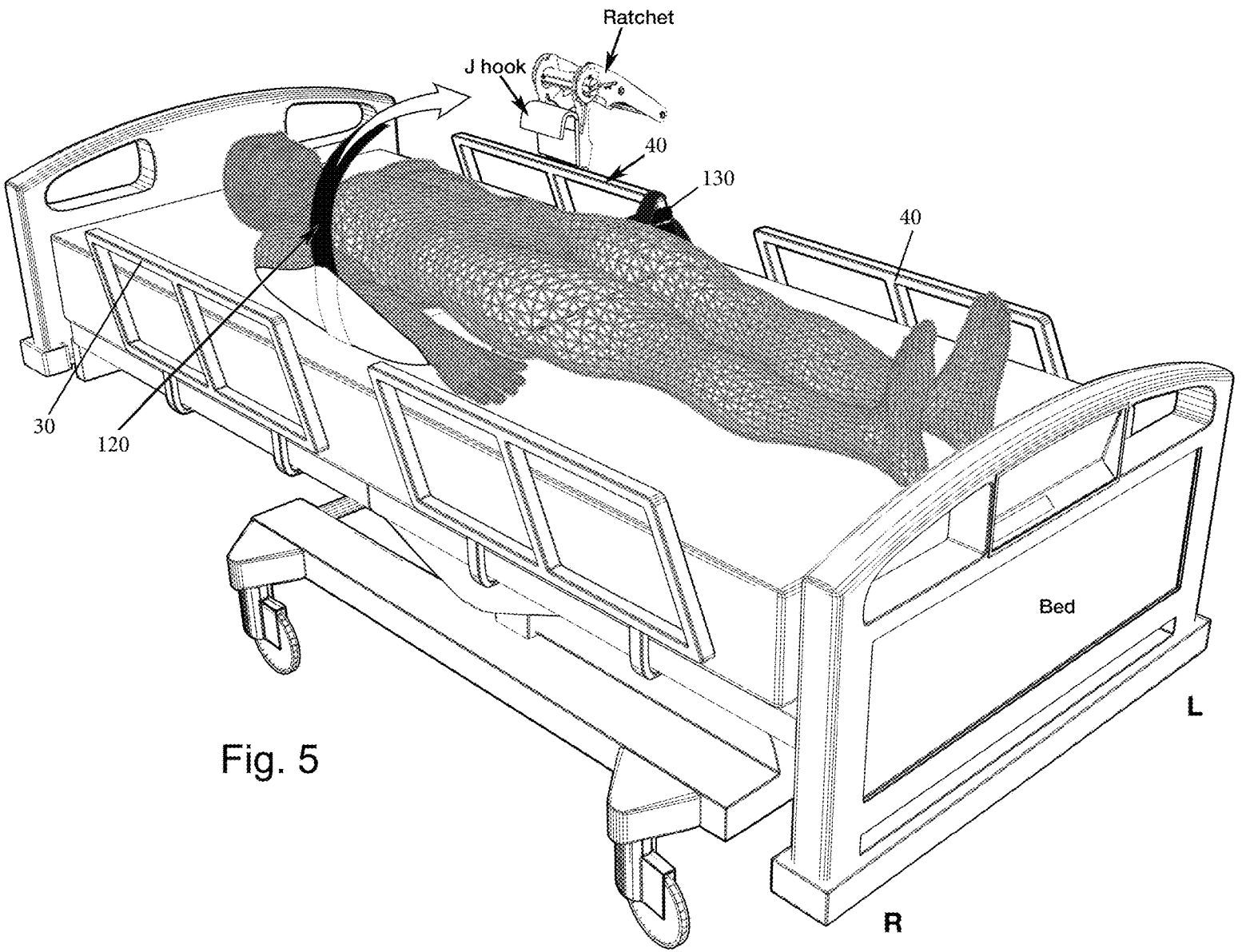
FIG. 5 is a perspective view of the system illustrating a fourth step of the method.

FIG. 5 shows the free first sling strap 120 being lifted and pulled over the patient's body in the direction toward the secured second sling strap 130.

Figure 6:
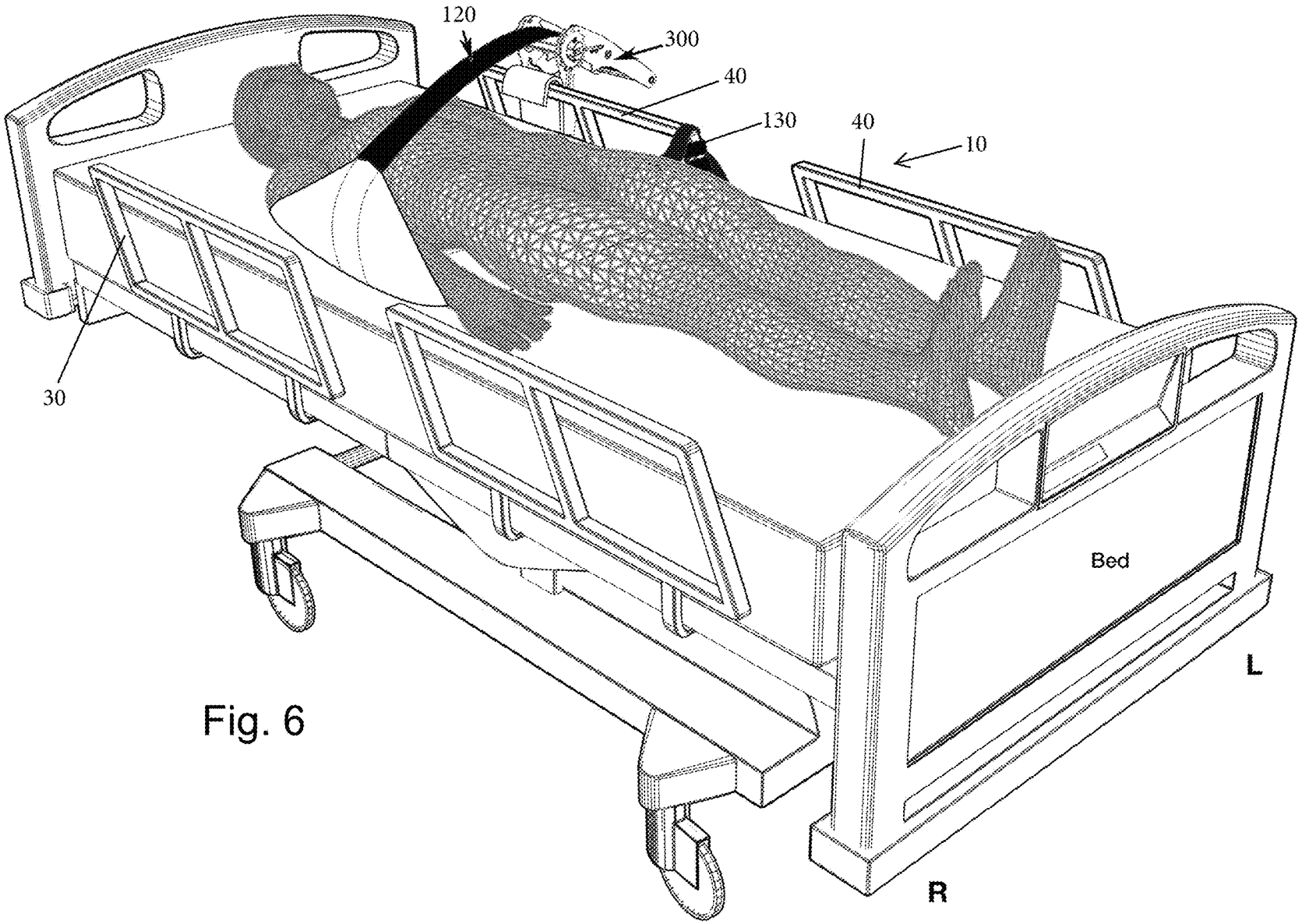
FIG. 6 is a perspective view of the system illustrating a fifth step of the method.

FIG. 6 shows the first sling strap 120 being fed into the ratchet device 300 which is coupled to the side rail 40. More specifically, the curved portion 353 of the mount portion 350 is placed over the top rail 60, thereby effectively hanging (suspending) the ratchet device 300 from the side rail 40. The mount portion 350 is fixed to the base portion 312 at a location that permits the webbing (first or second sling strap 120, 130) to be easily inserted into the slot 335. As shown, the length of the first sling strap 120 can be selected such that insertion of the free end thereof into the ratchet device 300 causes the first end 115 to lift off of the bed 10 and be snug against the side of the patient's body (without lifting the patient). As shown, the patient's arms are laid flat next to the torso.

It will be appreciated that the ratchet device 300 can be installed at any point in time after raising of the side rail 40 (FIG. 3).

Figure 7:
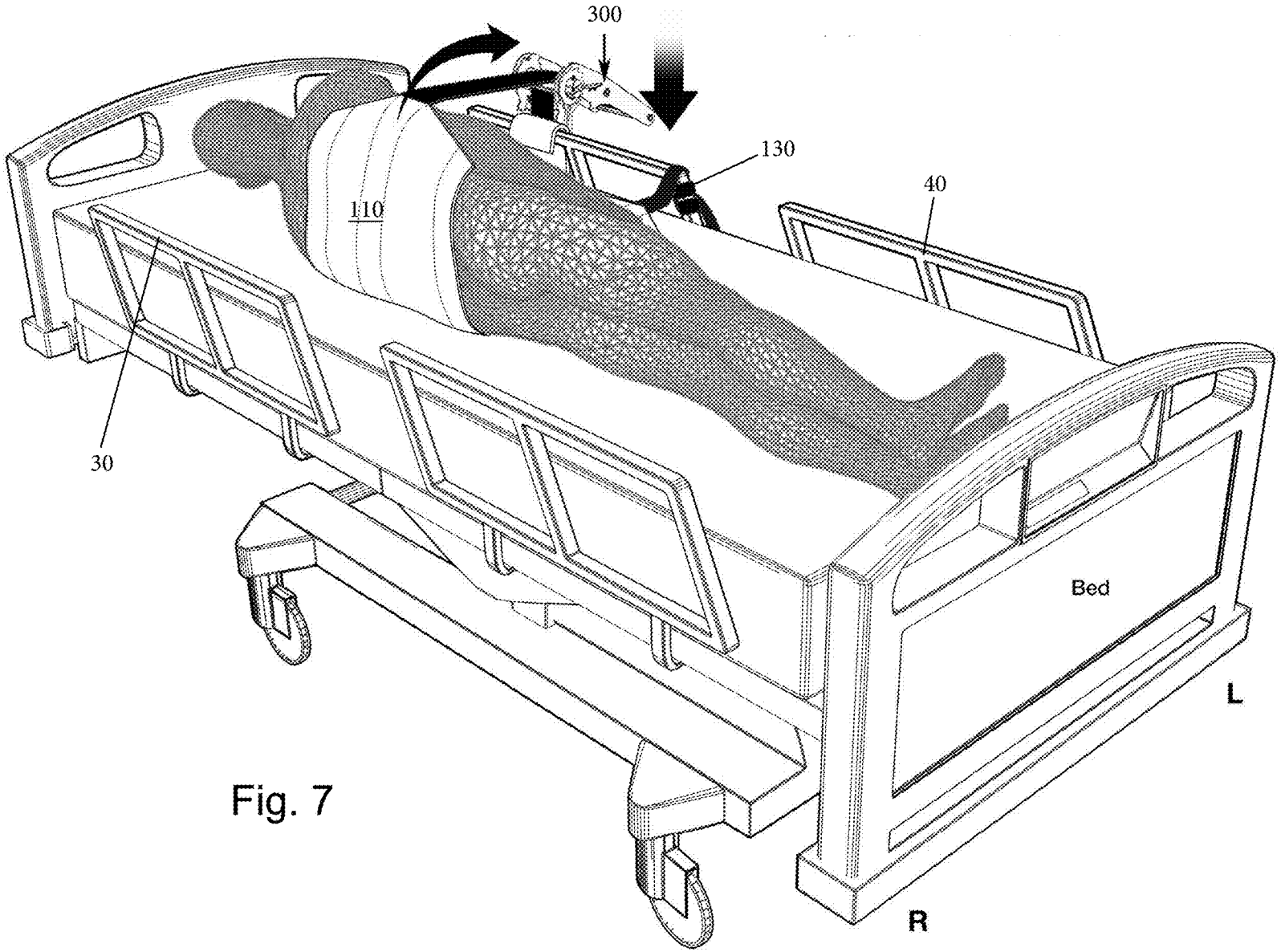
FIG. 7 is a perspective view of the system illustrating a sixth step of the method.

FIG. 7 illustrates operation of the ratchet device 300 which causes the first end 115 of the sling to be continuously lifted and pulled toward the ratchet device 300 and side rail 40. This results in the patient being turned over in the direction toward the side rail 40 (and ratchet device 300). Since the first sling strap 120 is under tension due to action of the ratchet device 300, the patient is maintained in this rolled over position. This allows the patient to be easily cleaned and the bed linen can be changed.

Figure 8:
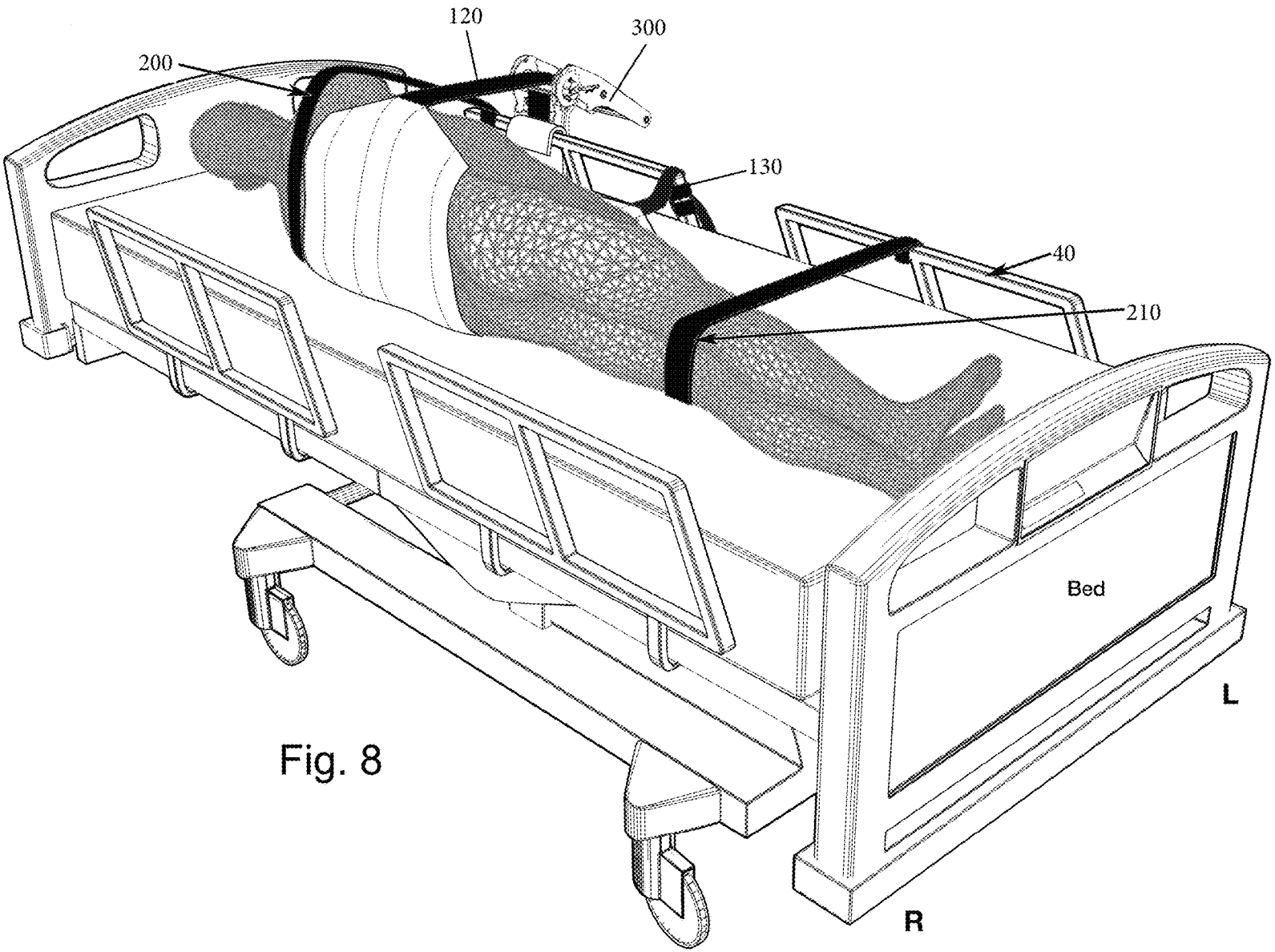
FIG. 8 is a perspective view of the system illustrating a seventh step of the method.

FIG. 8 shows an additional step for cleaning the patient's back in that the first strap 200 and the second strap 210 are placed under the patient's legs and shoulders, respectively. More specifically, the first strap 200 and second strap 210 are then secured to the bed rails 40 as by tying a knot or the like. As shown, one end of the second strap 210 can be secured around one leg using the first fastener 220 and the second fastener (which are attached to one another) and the opposite end of the second strap 210 is secured to the bed rail 40 (as by tying the end of the second strap 210).

Figure 9:
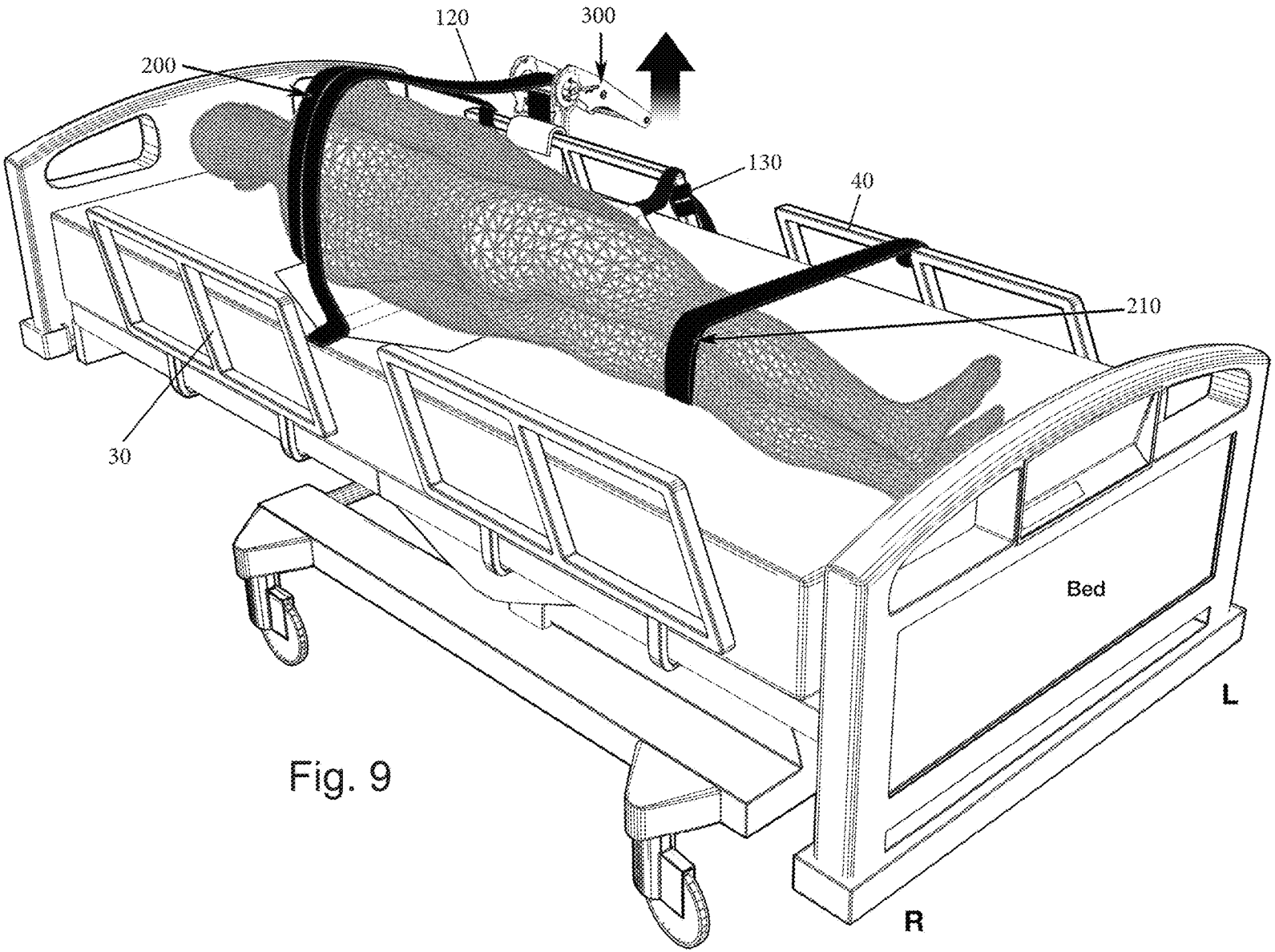
FIG. 9 is a perspective view of the system illustrating an eighth step of the method.

FIG. 9 shows that once the patient is secured using the first strap 200 and the second strap 210, the tension on the ratchet device 300 is released. With the ratchet device 300 released, the sling 110 lies flat on the bed 10.

Figure 10:
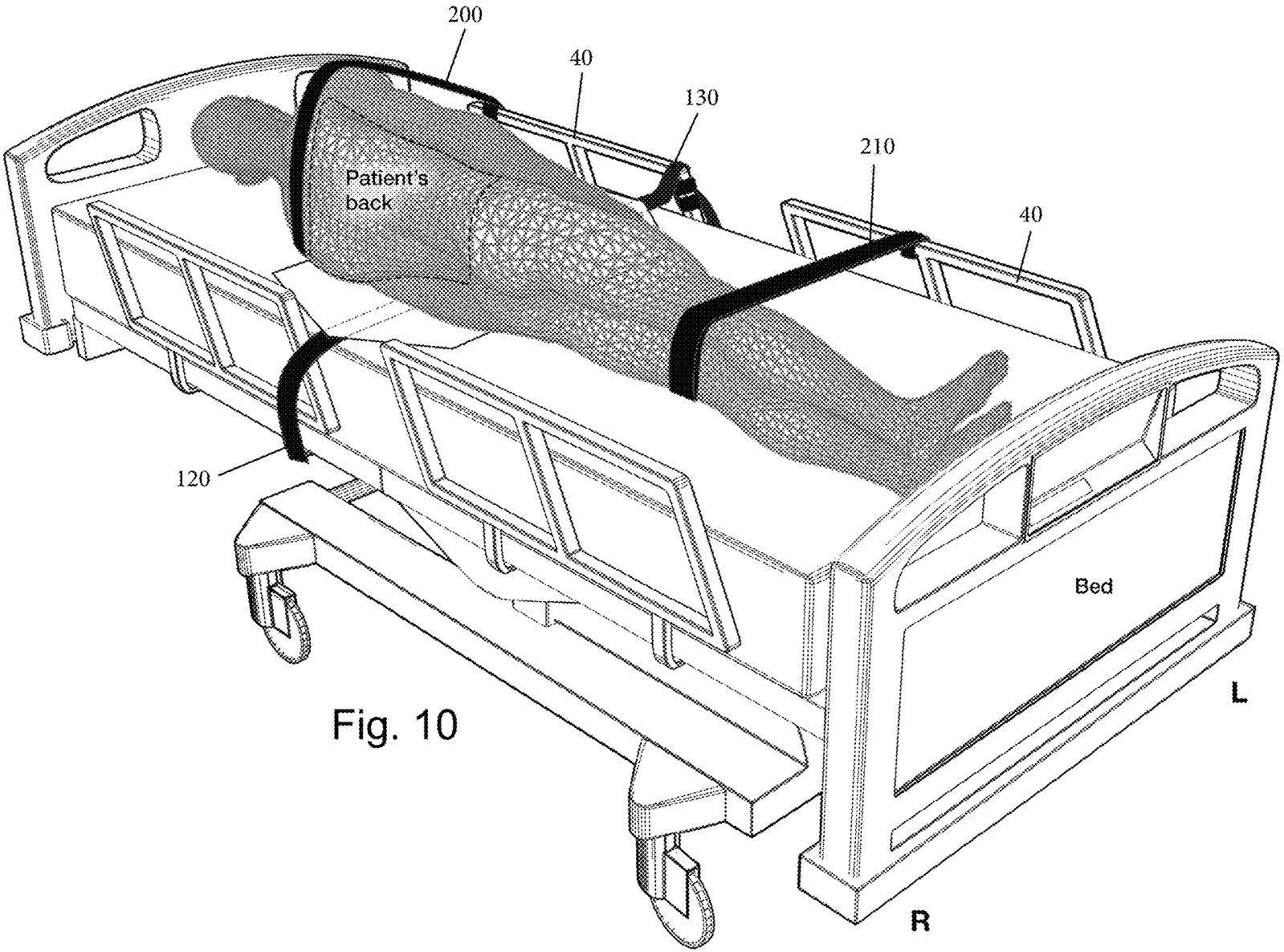
FIG. 10 is a perspective view of the system illustrating a ninth step of the method.

FIG. 10 shows that the ratchet device 300 can be removed from the side rail 40 with the patient maintained in the turned over position by the first strap 200 and the second strap 210. The back of the patient is then cleaned.

It will be appreciated that the opposite procedure can be performed in that the ratchet device 300 can be secured to the side rail 30 and the second sling strap 130 is fed into the ratchet device 300. Upon operation of the ratchet device 300, the second end 116 of the sling 110 is drawn toward the side rail 30 resulting in the patient being turned over in the direction toward the side rail 30.

The present invention is directed to a system that overcomes the disadvantages of conventional techniques and equipment. One will understand the need for the present system 100 if one considers the plight of bed-bound patients in hospitals, nursing homes, and other health-care facilities across the country and the plight of their care-givers; specifically, the nursing aids and orderlies who must turn these patients onto their sides in order to change their sheets and minimize their exposure to skin conditions, such as bed sores.

The present system 100 is thus a strap-and-ratchet system designed for deployment on and under hospital beds, the operation of which will enable a single health-care worker to easily, safely, and efficiently turn a patient onto either side and hold the patient there, comfortably, while the health-care worker cleans and tends to them and changes their sheets and then turns and lowers the patient once more onto their back. The system 100 can be a permanent feature of hospital beds 10 (i.e., the ratchet device 300 can be permanently mounted to the bed frame), or, as shown, the system 100 can be deployed with any existing bed on an as-need basis.

As illustrated and described herein, the system 100 is configured to fasten to the underside of the hospital bed 10, and feature three length-adjustable straps which run across the bed 10. It will be understood that one or more of the straps can contain comfort padding or the like. For example, the comfort padding can be disposed over the strap and can be in the form of natural or synthetic fleece.

With the present invention, a single health-care worker would be able to turn the patient, with no strain or discomfort to either the patient or the worker, and then hold the patient in place on his or her side. The system is then lowered and the patient is returned to the supine position. Because the system 100 enables a single worker to perform this procedure (which until now has required two workers), the system 100 frees up the second worker to attend to other patients, thereby improving patient care while reducing the necessary amount of labor, per patient. The device 100 is thus welcomed by not only by the health-care workers (nurses, nurse's aides, orderlies) who would use it, but by hospitals and other health-care facilities which employ these workers.

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed is:

1. A system for controllably turning over a patient in a bed comprising:

a flexible sling that includes a main torso portion that terminates in a first end and an opposing second end and is configured for placement under the patient between a head and a tailbone of the patient, the flexible sling having a first sling strap that is coupled to the first end and a second sling strap that is coupled to the second end; and a ratchet device having a mount that includes a curved portion for placement over a side rail of the bed to detachably secure the ratchet device to the bed, the ratchet device having a ratchet portion with a rotatable spool with a slot for receiving one of the first sling strap and the second sling strap, the ratchet portion having a pivotable handle for driving the rotatable spool;

wherein the curved portion has a U-shape and is defined by an inner wall for placement inside the side rail and an outer wall for placement outside the side rail, with a space being formed therebetween for receiving the side rail of the bed, the ratchet portion being disposed along an outer surface of the outer wall.

2. The system of claim 1, wherein the first end of the flexible sling is an angled, pointed end and the second end of the flexible sling is an angled, pointed end, with the first sling strap being attached to the first end at a point of the first end and the second sling strap being attached to the second end at a point of the second end.

3. The system of claim 1, wherein the flexible sling is sized so that when the flexible sling is placed under the patient, the first end and first sling strap and the second end and the second sling strap are located along beside a torso of the patient.

4. The system of claim 1, wherein the mount of the ratchet device comprises a J-shaped hook.

5. The system of claim 4, wherein the ratchet device has a base portion that is coupled to the handle such that the handle can pivot relative to the base portion, the base portion being attached to the mount.

6. The system of claim 4, wherein the curved portion curves in a direction that is away from the handle.

7. The system of claim 1, further including a first body strap and a second body strap, the first body strap for placement underneath shoulders of the patient and the second body strap for placement underneath legs of the patient.

8. The system of claim 7, wherein each of the first body strap and the second body strap includes a first fastener to allow the respective strap to fold over and attach to itself.

9. The system of claim 8, wherein the first fastener includes hook and loop material, the first body strap and the second body strap including a second fastener that is complementary to the first fastener to allow attachment of one end of the respective strap to an intermediate portion of the respective strap.

10. The system of claim 1, wherein the flexible sling includes a first edge and a second edge that is parallel to the first edge, the first and second edges extending between the first and second ends, wherein the first end and the second end is defined by two edges that are angled and converge to a point.

11. The system of claim 1, wherein the ratchet portion has a base portion that is fixedly coupled to an outer surface of the outer wall, wherein at least a section of the inner wall and the outer wall are parallel to one another and extend in a longitudinal direction which is a direction in which the base portion of the ratchet portion also extends.

12. The system of claim 1, wherein the spool lies outward relative to the outer wall of the curved portion.

13. The system of claim 1, wherein the curved portion has a curved intermediate section that lies between the inner wall and the outer wall, the curved intermediate section being configured to seat against an exposed top edge of the side rail.

14. A method for controllably turning a patient over in a bed that includes a first side rail that extends upwardly from a bed surface comprising the steps of:

placing a body sling underneath a patient between a head and tailbone of the patient, the body sling having a first sling strap that is coupled to a first end of the body sling and a second sling strap that is coupled to a second end of the body sling;

attaching the second sling strap of the body sling to the first side rail;

attaching a ratchet device to the first side rail, wherein the first side rail has a top edge and the ratchet device has a J-shaped mount defined by an inner portion and an outer portion spaced from the inner portion with a curved portion defined therebetween, the J-shaped mount being inserted onto the first side rail such that the curved portion seats against the top edge of the first side rail and the inner portion is located inside the first side rail and terminates at a location above the bed surface, while the outer portion is located outside the first side rail; and inserting the first sling strap into a rotatable spool of the ratchet device and operating the ratchet device so as to draw the first sling strap toward the ratchet device resulting in the patient being turned over along a top of the bed.

15. The method of claim 14, wherein the J-shaped mount faces in a direction opposite a handle that is operable to rotate the rotatable spool.

16. The method of claim 14, further including a first body strap and a second body strap, the first body strap being positioned underneath shoulders of the patient and secured at one end to the first side rail and the second body strap being positioned underneath at least one leg of the patient and secured at one end to the first side rail.

17. The method of claim 16, further including a step of loosening the first sling strap with the ratchet device after the first body strap is secured to the shoulders of the patient and to the first side rail and second body strap is secured to the at least one leg of the patient and to the first side rail.

18. The method of claim 17, wherein the first side rail comprises two separate independent side rails, the first sling strap being secured to one of the side rails and the second sling strap being secured to the other of the side rails.

19. The method of claim 16, wherein each of the first body strap and the second body strap includes a first fastener to allow the respective strap to fold over and attach to itself.

20. A device for controllably turning over a patient in a bed comprising:

a ratchet having a mount that includes a curved portion for placement over a side rail of the bed to detachably secure the ratchet device to the bed, the ratchet having a ratchet portion with a rotatable spool with a slot for receiving a sling strap of a sling for placement beneath the patient, the ratchet portion having a pivotable handle for driving the rotatable spool;

wherein the curved portion has a U-shape and is defined by an inner wall for placement inside the side rail and an outer wall for placement outside the side rail, with a space being formed therebetween for receiving the side rail of the bed to allow the ratchet to hang from the side rail, the ratchet portion being disposed along an outer surface of the outer wall.

* * * * *